US010669728B2

(12) United States Patent
Estereicher

(10) Patent No.: US 10,669,728 B2
(45) Date of Patent: Jun. 2, 2020

(54) BLISTER PACKAGE WITH DETACHABLE KNIFE

(71) Applicant: Ivan John Estereicher, Livonia, MI (US)

(72) Inventor: Ivan John Estereicher, Livonia, MI (US)

(73) Assignee: I S E PRODUCTS, INC., Livonia, MI (US)

( * ) Notice: Subject to any disclaimer, the term of this patent is extended or adjusted under 35 U.S.C. 154(b) by 38 days.

(21) Appl. No.: 15/899,738

(22) Filed: Feb. 20, 2018

(65) Prior Publication Data

US 2018/0245355 A1 Aug. 30, 2018

Related U.S. Application Data

(60) Provisional application No. 62/464,252, filed on Feb. 27, 2017.

(51) Int. Cl.

| | |
|---|---|
| ***E04F 21/32*** | (2006.01) |
| ***B65D 75/58*** | (2006.01) |
| ***E04F 21/06*** | (2006.01) |
| ***B05C 17/10*** | (2006.01) |
| ***E04G 23/02*** | (2006.01) |

(52) U.S. Cl.

CPC ..... *E04F 21/32* (2013.01); *B05C 17/10* (2013.01); *B65D 75/5811* (2013.01); *E04F 21/06* (2013.01); *E04G 23/0203* (2013.01); *B65D 2221/00* (2013.01)

(58) Field of Classification Search

CPC ..... B05C 17/10; B65D 47/10; B65D 75/36; B65D 85/74; B65D 2221/00; E04F 21/06; E04F 21/32; E04G 23/02; E04G 23/0203

USPC ..... 206/459.5, 461–471, 484; 222/92–107; 401/183, 184, 187, 192

See application file for complete search history.

(56) References Cited

U.S. PATENT DOCUMENTS

| | | | | |
|---|---|---|---|---|
| 3,453,661 | A * | 7/1969 | Repko | B65B 9/023 206/484 |
| 3,913,734 | A * | 10/1975 | Siegel | B65D 75/366 206/470 |
| 4,415,084 | A * | 11/1983 | Hauser | B65D 75/366 206/461 |
| 4,648,506 | A | 3/1987 | Campbell | |
| 4,797,309 | A * | 1/1989 | Kammerer | B65D 75/52 206/484 |
| 5,111,932 | A * | 5/1992 | Campbell | B65D 75/5855 206/216 |
| 5,577,851 | A | 11/1996 | Koptis | |

(Continued)

FOREIGN PATENT DOCUMENTS

| | | | |
|---|---|---|---|
| WO | 9418931 | A1 | 9/1994 |
| WO | 2004094240 | A2 | 11/2004 |

(Continued)

*Primary Examiner* — Bryon P Gehman

(74) *Attorney, Agent, or Firm* — Carlson, Gaskey & Olds, P.C.

(57) ABSTRACT

A disposable blister package according to an example of the present disclosure includes a first portion and a second portion. A cavity is formed in the second portion and contains a compound. The first portion is separable from the second portion at a snap line, and the first portion is operable to spread the compound.

19 Claims, 5 Drawing Sheets

(56) References Cited

U.S. PATENT DOCUMENTS

| | | | | |
|---|---|---|---|---|
| 6,726,054 | B2 * | 4/2004 | Fagen | B65D 75/366 206/449 |
| 7,185,783 | B1 * | 3/2007 | Miller | B65F 1/14 206/515 |
| 7,241,066 | B1 * | 7/2007 | Rosen | A46B 11/0003 206/459.5 |
| 7,506,762 | B2 * | 3/2009 | Nelson | B65B 61/02 206/229 |
| 8,061,563 | B1 * | 11/2011 | Rosen | B65D 75/5811 206/484 |
| 8,376,183 | B1 * | 2/2013 | Rosen | B65D 81/3266 222/1 |
| 8,381,474 | B2 | 2/2013 | Lewis | |
| 8,839,538 | B2 * | 9/2014 | Franko, Sr. | G06K 19/07758 222/93 |
| 9,469,435 | B2 | 10/2016 | Greenland | |
| 9,481,009 | B2 | 11/2016 | Evans | |
| 2005/0217034 | A1 | 10/2005 | Miller et al. | |
| 2006/0245819 | A1 | 11/2006 | Owens | |
| 2008/0115443 | A1 | 5/2008 | Hathaway | |
| 2010/0264044 | A1 * | 10/2010 | Beihoffer | A45D 34/04 206/204 |
| 2013/0251860 | A1 * | 9/2013 | Johannaber | B65D 85/72 426/115 |

FOREIGN PATENT DOCUMENTS

| | | | |
|---|---|---|---|
| WO | 2006102944 | A1 | 10/2006 |
| WO | 2015148397 | A1 | 10/2015 |

* cited by examiner

BLISTER PACKAGE WITH DETACHABLE KNIFE

CROSS REFERENCE TO RELATED APPLICATIONS

This application claims priority to U.S. Provisional Application Ser. No. 62/464,252, filed Feb. 27, 2017.

BACKGROUND

This application relates to a blister package with a detachable knife that can be used to spread joint compound discharged by the blister package.

In order to fix small wall holes, for example nail holes caused by hanging pictures, consumers have been forced to purchase an unnecessarily large amount of joint compound and also a separate spackle knife. This leads to an unnecessary waste of money and material. Additionally, the consumer may be left with a tool (spackle knife) which they have no intention of reusing.

SUMMARY

A disposable blister package according to an example of the present disclosure includes a first portion and a second portion. A cavity is formed in the second portion and contains a compound. The first portion is separable from the second portion at a snap line, and the first portion is operable to spread the compound.

A disposable blister package according to an example of the present disclosure includes a top container layer adjacent to a bottom backing layer. The top container layer defines a cavity containing a compound. The bottom backing layer includes a rough textured surface.

A method of repairing a surface according to an example of the present disclosure includes providing a blister package including a first portion and a second portion separated by a snap line. A cavity is formed in the second portion and contains a compound. A discharge channel is in fluid communication with the cavity and extends across the snap line. The method further includes bending the blister package at the snap line until the discharge channel opens. The first portion is removed from the second portion at the snap line and the compound is spread with the detached first portion.

DETAILED DESCRIPTION

Figure 1:
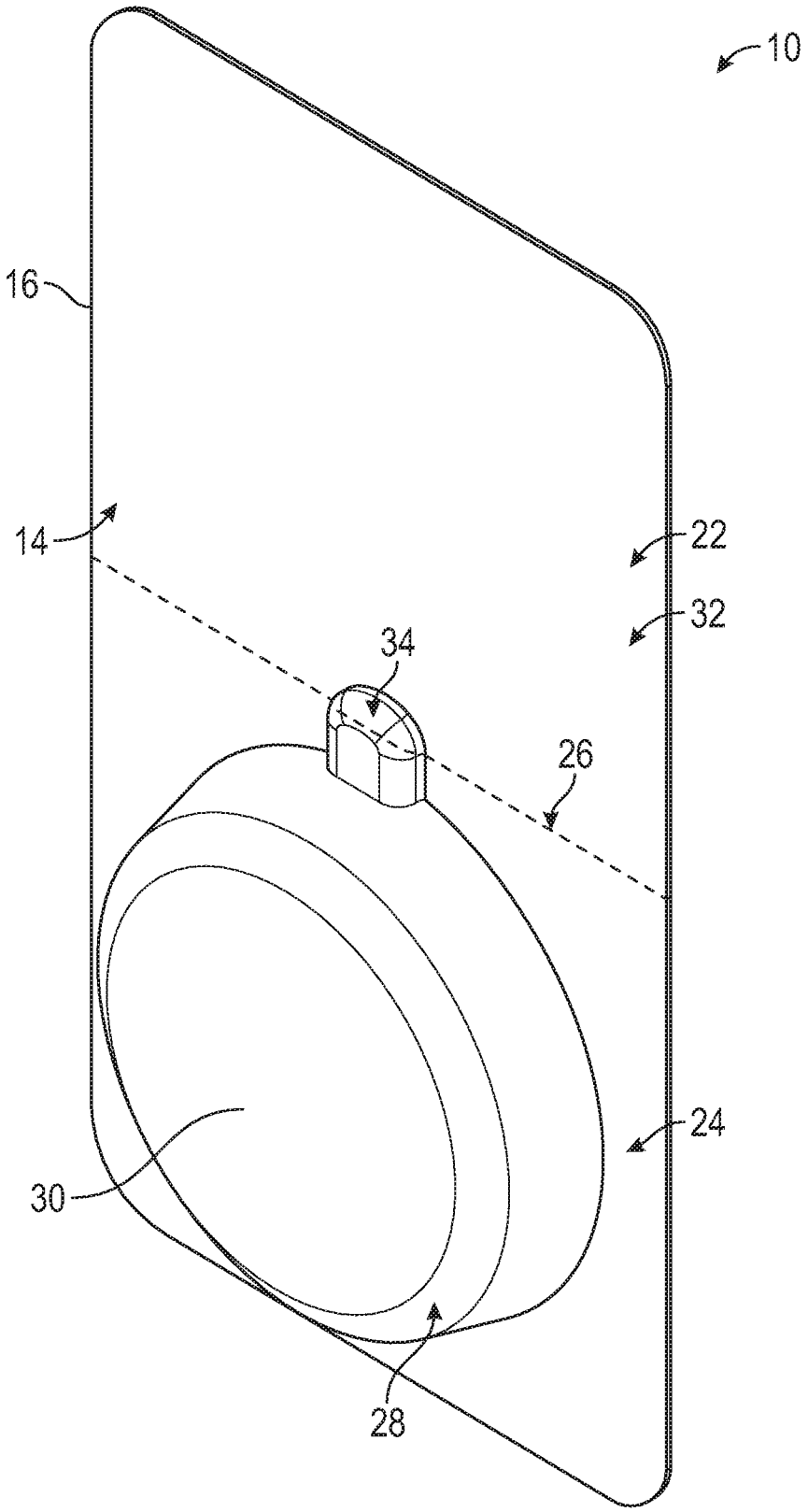
FIG. 1 illustrates a disposable, single use blister package.

A disposable, single-use package 10 is illustrated in FIG. 1. The package 10 is generally a blister package comprised of a top container layer 14 secured to a bottom backing layer 16. A cavity 28 is formed in the top container layer 14 and sealed by the backing layer 16. In this embodiment, the top container layer 14 of the package 10 may be made of thermoformed plastic, such as High Density Polyethylene, Low Density Polyethylene, Polyethylene Terephthalate, Polypropylene, Polystyrene, or Polyvinyl Chloride. The bottom backing layer 16 may be made of foil.

The package 10 is further divided into a first portion 22 and a second portion 24 by a manufactured snap-line 26. The snap-line 26 may be, but is not limited to, a perforated line, a weakened line, or a scored line formed in the top container layer 14 and the bottom backing layer 16. The first portion 22 is mostly a stiffened surface configured to act as a detachable spackling knife 32. The second portion 24 includes the cavity 28. The first portion 22 is preferably at least ⅓ of the surface area of the package 10, and more preferably approximately half the area of the package 10.

The package further comprises an extended discharge channel 34 which extends from the cavity 28 and is in fluid communication with the cavity 28. The extended discharge channel 34 extends from the second portion 24 across the snap-line 26 and slightly into the first portion 22. The extended discharge channel 34 is defined in the top container layer 14 and sealed by the backing layer 16. A joint compound 30 is contained in the cavity 28 and the extended discharge channel 34 and sealed between the top container layer 14 and the bottom backing layer 16.

Figure 2:
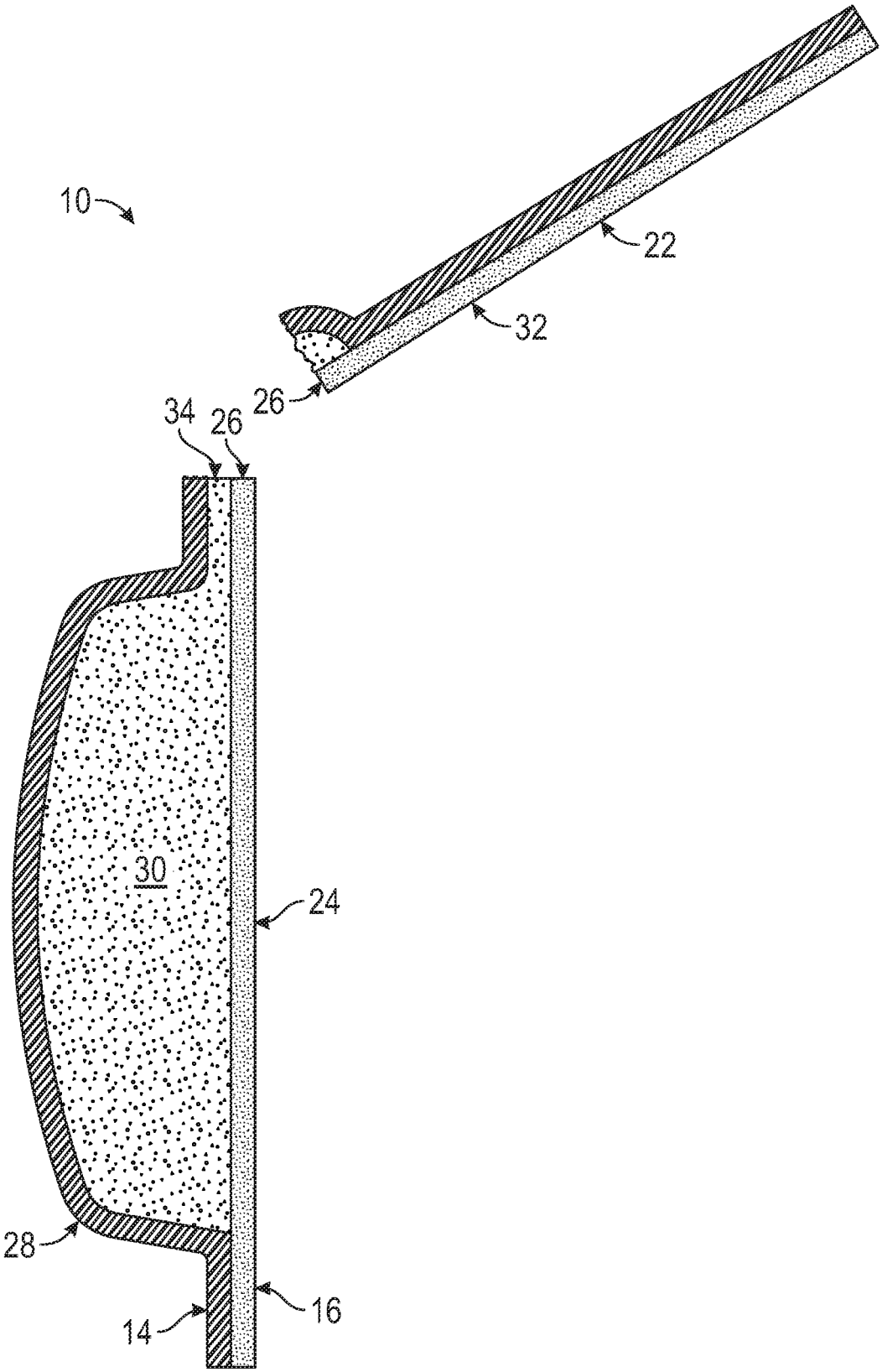
FIG. 2 illustrates a side view cross-section of the package of FIG. 1 after opening.

In use, the package 10 is bent at the snap-line 26 so that the seal of the cavity 28 is broken at the extended discharge channel 34, as illustrated in FIG. 2. This action also separates the first portion 22 from the second portion 24. When the seal of cavity 28 broken, applying pressure to the top container layer 14 at the cavity 28 will discharge the joint compound 30 out of the extended discharge channel 34. The snap-line 26 also defines one of the edges of the spackle knife 32, although preferably the opposite edge of the spackle knife 32 would be used to spread the joint compound 30. The snap-line 26 eliminates the need for scissors and the single-use feature ensures that the contents of cavity 28 are fresh and sealed.

The package 10 functions as a disposable joint compound supply and applicator for surface repairs. In one example, the size of the package 10 may be approximately 65 mm×26.5 mm×7 mm, and contain about 2 mL of joint compound 30, although other dimensions may be utilized. The joint compound 30 may be any spreadable compound. In preferred embodiments, joint compound 30 may be a paste, specifically spackling, wall repair mud, glazing compound, or patching compound.

Figure 3:
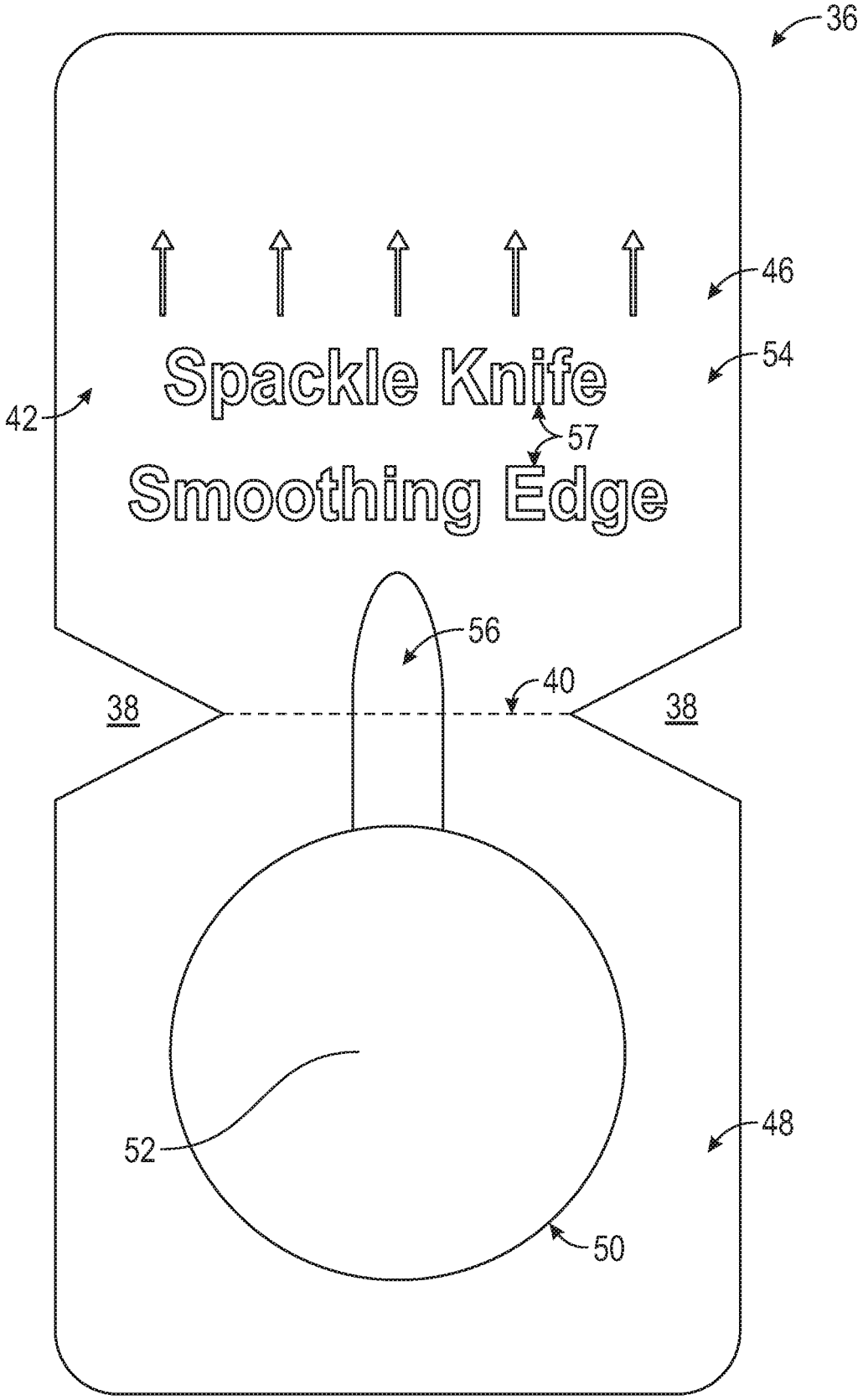
FIG. 3 illustrates an alternative package.

FIG. 3 illustrates a second embodiment in which a package 36 may include at least one notch 38 (two shown) located proximate to a snap-line 40. The package 36 further comprises a top container layer 42, a bottom backing layer 44, a first portion 46, a second portion 48, a blister package 50 containing joint compound 52, a detachable spackle knife 54, and an extended discharge channel 56. The notch 38 accentuates the snap-line 40, and shortens the length of the snap-line 40, which makes it easier to snap the blister package 50 open and remove the spackle knife 54. The package 36 is configured similarly to the package 10 of FIGS. 1 and 2 described above, except as otherwise described or shown. All of the above disclosure related to package 10, including use and potential materials, may be applied to package 36.

FIG. 3 further illustrates that the package 36 may include thermoformed text 57 on the first portion 46 of the top container layer 42. The thermoformed text 57 serves to stiffen the detached spackle knife 54, and allow the spackle knife 54 to smooth out the joint compound 52 without excessive bending. Additionally, the thermoformed text 57 provides instruction and/or adds to the overall aesthetic of the package 36. Although example thermoformed text 57 is illustrated, other words or instructions may be utilized.

Figure 4:
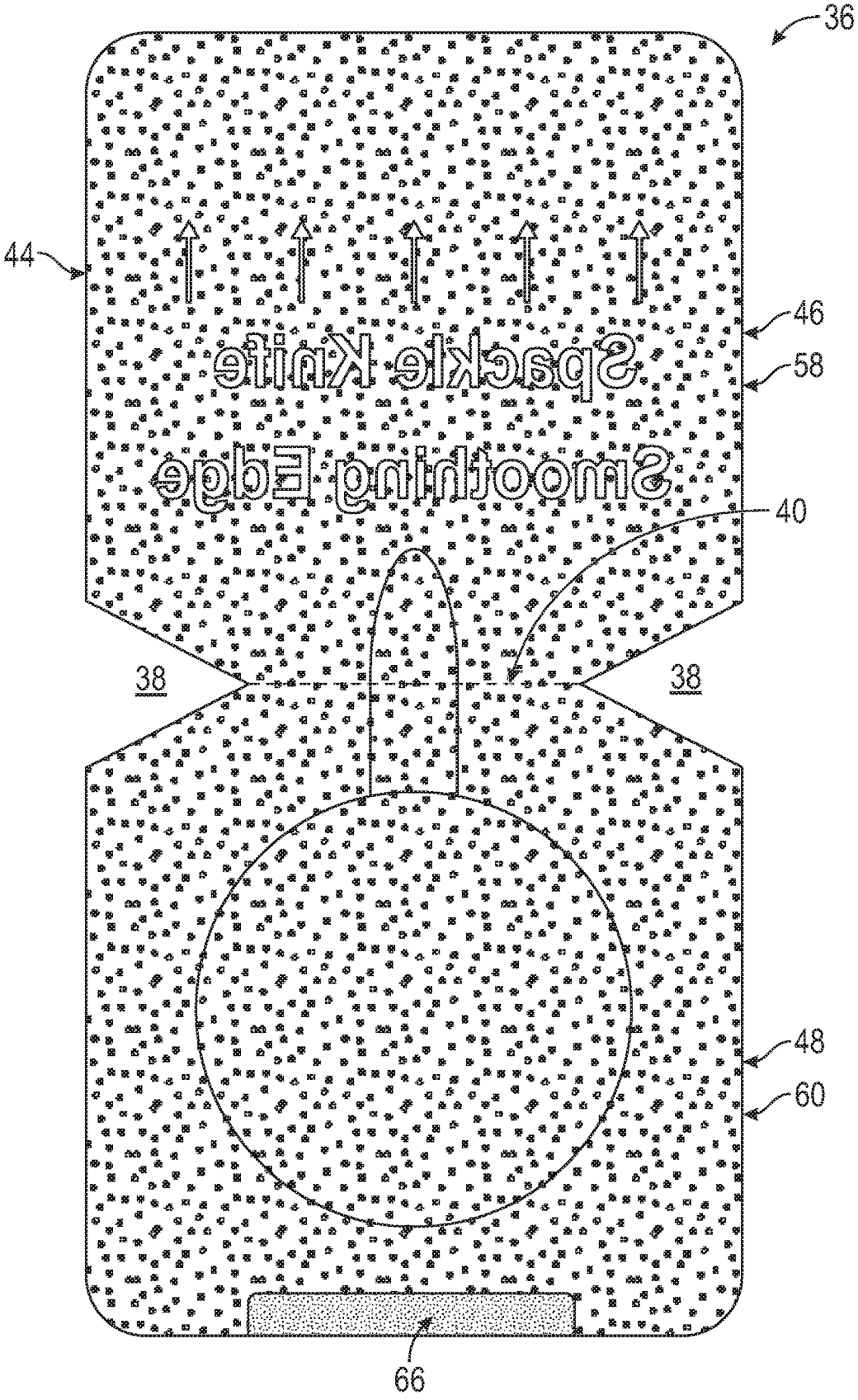
FIG. 4 illustrates a back view of the package of FIG. 3.

FIG. 4 illustrates the bottom of the package 36 of FIG. 3. The bottom backing layer 44 includes a bottom surface 58 of the first portion 46 and a bottom surface 60 of the second portion 48. One or both of the bottom surfaces 58, 60 of the bottom backing layer 44 may be a rough textured surface that can act as an abrasive, such as sand paper, and be used to smooth down the joint compound 52 once applied. For example, if the bottom backing layer 44 is foil, the foil may be stamped to have a stippled, abrasive surface. If the bottom backing layer 44 is paperboard (or the like), it may have a sandpaper layer.

FIG. 4 also illustrates that the bottom backing layer 44 of package 36 may be peel-able and may have an opening tab 66. The peel-able bottom backing layer 44 allows a user to peel off the bottom backing layer 44 of the second portion 48 and expose the content of the blister package 50. The opening tab 66 may be provided to make it easier to remove the bottom backing layer 44. With the bottom backing layer 44 removed, all the joint compound 52 remaining after initial use is accessible.

Figure 5:
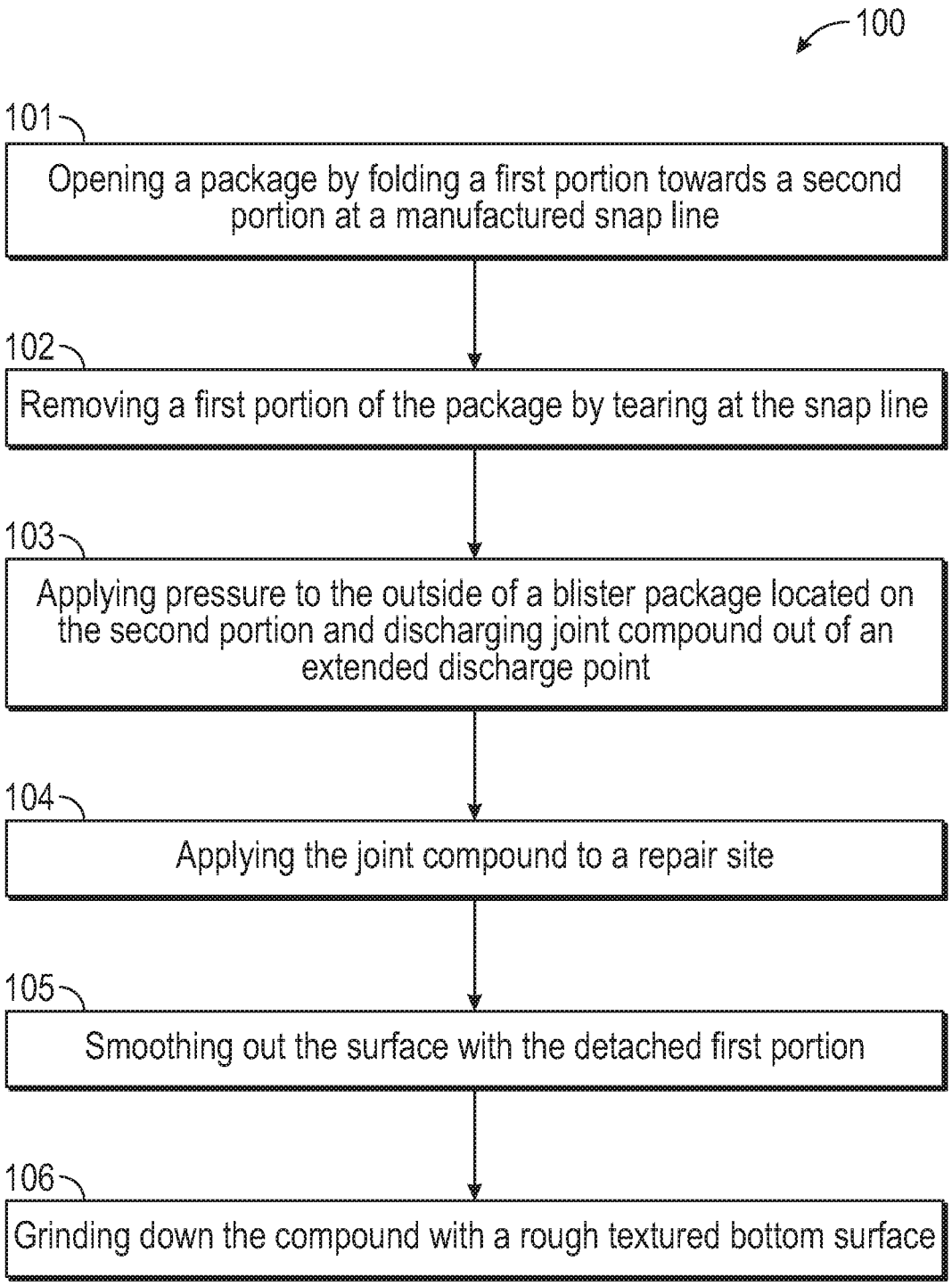
FIG. 5 illustrates a method for repairing a surface.

FIG. 5 illustrates a method 100 for repairing a surface. Step 101 includes opening a package 36 by folding the first portion 46 towards the second portion 48 at a manufactured snap-line 40 until the tip of the extended discharge channel 34 opens or "snaps." Step 102 includes removing the first portion 46 by tearing at the snap line 40. Step 103 includes manually applying pressure to the outside of a blister package 50 located on the second portion 28, which will discharge joint compound 52 out of an extended discharge channel 56. Step 104 includes applying the joint compound 52 to a repair site. Step 105 includes smoothing out the surface with the detached first portion 46. After the joint compound 52 dries, step 106 includes grinding down the joint compound 52 with a rough textured bottom surface(s) 58, 60 of the package 36.

It should be recognized that the invention can be practiced other than exactly as described. Additionally, there are other products that can be provided in the packages 10, 36. For example, adhesive paste, resin or epoxy may benefit from this packaging and the inclusion of the knife 32, 54. As another category of examples, spreadable food products, such as butter, cheese, peanut butter, etc could also be provided in this packaging and benefit from the inclusion of the knife 32, 54. Accordingly, the following claims should be studied to determine their true scope and content.

The invention claimed is:

1. A disposable blister package, comprising:
- a first portion and a second portion;
- a cavity formed in the second portion, the cavity containing a compound;
- a discharge channel in fluid communication with the cavity that extends across a snap line;
- wherein the first portion is separable from the second portion at the snap line; and
- wherein the first portion is operable to spread the compound.

2. The blister package of claim 1, further comprising thermoformed text on the first portion, the thermoformed text providing additional stiffness to the first portion.

3. The blister package of claim 1, further comprising at least one notch proximate to the snap line.

4. The blister package of claim 1, wherein the compound comprises at least one of spackling, wall repair mud, glazing compound, and patching compound.

5. The blister package of claim 1, wherein the snap line is one of a perforated line, a weakened line, and a scored line.

6. The blister package of claim 1, wherein the first portion comprises at least one third of the surface area of the blister package.

7. The blister package of claim 1, further comprising a top container layer adjacent to a bottom backing layer, wherein the top container layer defines the cavity and the bottom backing layer seals the compound within the cavity.

8. The blister package of claim 7, wherein the bottom backing layer includes a rough textured surface.

9. The blister package of claim 7, further comprising an opening tab for peeling the bottom backing layer to expose the compound within the cavity.

10. The disposable blister package of claim 7, wherein the top container layer and bottom backing layer are made of different materials.

11. The disposable blister package of claim 10, wherein the top container layer is made of thermoformed plastic.

12. The disposable blister package of claim 11, wherein the bottom backing layer is foil.

13. The disposable blister package of claim 1, wherein the compound is a joint compound.

14. A disposable blister package, comprising:
- a top container layer adjacent to a bottom backing layer, wherein the top container layer defines a shaped cavity containing a compound;
- wherein the bottom backing layer seals the compound within the cavity; and
- wherein the bottom backing layer includes a rough textured surface.

15. The blister package of claim 14, wherein the bottom backing layer is foil, and the rough textured surface is a stamped foil surface.

16. The blister package of claim 14, wherein the bottom backing layer is paperboard, and the rough textured surface is a sandpaper surface.

17. The disposable blister package of claim 14, wherein the top container layer is thermoformed plastic and the bottom backing layer is made of a different material.

18. The disposable blister package of claim 17, wherein the bottom backing layer is foil.

19. A disposable blister package, comprising:
- a thermoformed plastic top container layer adjacent to a foil bottom backing layer, the top container layer shaped to define a cavity and the bottom backing layer sealing a joint compound within the cavity;
- wherein the top container layer defines a first portion and a second portion, the cavity formed in the second portion;
- wherein the top container layer is further shaped to define a discharge channel in fluid communication with the cavity that extends from the first portion to the second portion across a snap line; and
- wherein the first portion is separable from the second portion at the snap line, and is operable to spread the joint compound.

* * * * *